US005568176A

United States Patent [19]

Moon et al.

[11] Patent Number: 5,568,176

[45] Date of Patent: Oct. 22, 1996

[54] THERMAL PRINT HEAD AND METHOD OF MAKING THE SAME

[75] Inventors: Kyung-Ha Moon; Bae-Won Lee, both of Suwon; Hong-Geun Yang, Seoul, all of Rep. of Korea

[73] Assignee: Samsung Electronics Co., Ltd., Suwon, Rep. of Korea

[21] Appl. No.: 560,914

[22] Filed: Nov. 20, 1995

[30] Foreign Application Priority Data

Jul. 14, 1995 [KR] Rep. of Korea ..... 95-20790

[51] Int. Cl.[6] ..... B41J 2/335

[52] U.S. Cl. ..... 347/200

[58] Field of Search ..... 347/200, 201, 347/205, 208, 209

[56] References Cited

U.S. PATENT DOCUMENTS 4,837,586 6/1989 Brownstein ..... 347/205

5,252,988 10/1993 Katayama et al. ..... 347/208

5,285,216 2/1994 Ota et al. ..... 347/209

*Primary Examiner*—Huan H. Tran

[57] ABSTRACT

A thermal print head and method of creating the same, in which a metal film and a cooling compound are inserted between a resistance substrate and a cooling board. This construction can prevent the formation of air bubbles in the cooling compound between the resistance substrate and the cooling compound. This construction can also reduce local heat accumulation and thereby reduce uneven priming contrast since even if an air bubble is formed it will have a thickness less than the thickness of a double-sided tape that acts as an adhesive between the resistance substrate and the cooling board. In addition, a clearer image can be obtained even in the hi-speed priming because the metal film having a thermal conductivity higher than that of the cooling compound is inserted inside the cooling compound. This increases the overall thermal conductivity between the resistance substrate and the cooling board and thus improves heat dissipation within the system.

8 Claims, 3 Drawing Sheets

THERMAL PRINT HEAD AND METHOD OF MAKING THE SAME

BACKGROUND OF THE INVENTION

1. Field of the Invention

The present invention relates to a thermal print head and method for making the same. More particularly, the present invention relates to a thermal print head and method for making the same in which a metal film and a cooling compound are inserted between a resistance substrate and a cooling board.

2. Description of the Prior Art

Thermal recording is a technique by which characters or graphics are recorded on white thermal paper based on the characteristic of white thermal paper that only heated portions are turned black. A thermal printer is a machine to which the above-mentioned technique of the thermal recording is applied. The thermal printer uses a thermal print head on which heating elements for converting electrical energy into heat energy are formed linearly like a row of dots.

When an operator using the thermal printer prints characters or graphics using the thermal printer, the heating elements are selectively heated to generate heat based on data inputted as an electrical signal while the thermal print head contacts a medium such as the thermal paper. The generated heat is applied to the thermal paper to record the characters or graphics as a series of dots. The image is formed by sequentially applying lines of data, i.e., heated dots, to the thermal paper.

A conventional thermal print head will be described in detail with reference to accompanying drawings hereinafter. FIG. 1 is a sectional view of a conventional thermal print head, and FIG. 2 is a perspective view illustrating a portion corresponding to a reference number, 10 in FIG. 1.

Referring to FIG. 1, the conventional thermal print head comprises a resistance substrate 1 connected to a driving substrate 30. The resistance substrate 1 is preferably made of ceramics or the like and has a plurality of heating elements 2 formed on a front surface. These heating elements 2 generate heat when they are supplied with current. The driving substrate 30 has a driving integrated circuit 21 formed on it, which separately drives the resistance substrate 1 and the heating elements 2.

Referring to FIG. 2, the heating elements 2 are linearly formed in a predetermined direction like a row of dots, and are selectively driven and heated selectively to generate heat on the thermal paper.

A cooling board 3 made of metal with high thermal conductivity is adhered to a rear surface of the resistance substrate 1 by an adhesive 4. The cooling board acts to dissipate heat generated by the heating elements 2. As shown in FIG. 1, a part of the cooling board 3 is connected to a part of the driving substrate 30 by the adhesive 4, thereby supporting the driving substrate 30. A connector 40 supports the remainder of the driving substrate 30.

A protector 22 protects the driving integrated circuit 21 by covering the driving integrated circuit 21, and a cover 20 provides further protection by covering over the protector 22. The cover 20 is attached to the driving substrate 30 by a screw 50.

A problem arises, however, when the thermal prim head is used at room temperature. Then, a surface temperature of the resistance substrate 1 can rise to as high as 200° C. due to the heat generated from the heating elements 2. Accordingly, heat accumulates and any excess heat generated from the heating elements 2 that does not contribute to printing must be dissipated. Otherwise, the excess heat might distort current and future prim jobs. When the dissipation of heat is not carried out efficiently, uneven printing contrast occurs due to heat accumulation. Accordingly, the cooling board 3 is attached to the lower part of the resistance substrate 1 to enhance heat dissipation.

Generally, a double-sided tape is used as the adhesive 4 to attach the cooling board 3 to the resistance substrate 1. Double-sided tape is used because the resistance substrate 1 and the cooling board 3 differ significantly in their coefficients of thermal expansion. If the resistance substrate 1 and the cooling board 3 were fixed directly, they would be warped by the heat during printing in the same way that a bimetal is warped by changes in its ambient temperature. The use of double-sided tape reduces the stress caused by the difference in coefficient of thermal expansion of the resistance substrate 1 and the cooling board 3 and thereby prevents the warping of the resistance substrate 1. In addition, using double-sided tape also simplifies production of the printer by making it easier to join the cooling board to the resistance substrate.

Double-sided tape is not without its problems, however. When the resistance substrate 1 and the cooling board 3 are joined by double-sided tape, heat generated by the resistance substrate 1 is not sufficiently dissipated into the cooling board 3. This occurs because the thermal conductivity of the double-sided tape is generally small, for example, less than $0.5\times10^{-3}$ cal/cm-sec-°C. The incomplete heat dissipation caused by using the double-sided tape results in uneven contrast and smearing of the printed image because too much heat remains in the resistance substrate 1. Accordingly, the double-sided tape cannot be used in high speed printers, color printers, high speed label printers, and the like, which require greater heat dissipation.

To overcome the above-mentioned disadvantage, a cooling compound can be used in place of some of the adhesive 4. Unfortunately, the thickness of the cooling compound can differ locally along the resistance substrate 1 because the manufacturing process results in areas having a difference in height on the order of tens to hundreds of microns. The uneven thickness in turn causes uneven cooling and therefore uneven contrast in the primed image.

To solve the disadvantages of using a cooling compound, the following thermal print head has been proposed, as shown in FIGS. 3 and 4 and described below.

Referring to FIG. 3, a cooling material or a cooling compound 6, in place of the adhesive 4, is inserted between the cooling board 3 and the area of the rear surface of the resistance substrate 1 corresponding to the area on the front surface where the heating elements 2 are formed. Two long grooves 5 are formed in the cooling board 3 in the direction in which the heating elements 2 are arranged. The adhesive 4 is positioned at both sides of the cooling compound 6, bordering on the grooves 5.

The cooling compound 6 is preferably a mixture of fine particles of aluminum oxide or zinc oxide in a size of 1 μm or less and, for example, silicon oil. It is preferably a viscous, greasy matter with a thermal conductivity in the range of 1.5 to $3.0\times10^{-3}$ cal/cm-sec-°C. To compare, the preferred cooling compound 6 possesses a thermal conductivity of 3 to 6 times higher than that of the adhesive 4.

After applying the cooling compound 6 between the long grooves 5 on the cooling board 3, the resistance substrate 1 is pressed together with the cooling board 3. As this is done, the cooling compound 6 is compressed and spread widely on the cooling board 3. The long grooves 5 are provided to hold the overflowing cooling compound 6.

As shown in the thermal head print illustrated in FIG. 4, a long central groove 5' may be formed on a part of the cooling board 3 corresponding to the area where the heating elements 2 are linearly formed. At both sides of the long central groove 5', grooves 5 are formed, and an adhesive with high thermal conductivity is inserted in them.

The thermal print head is manufactured by pressing the resistance substrate 1 and the cooling board 3 together at a high temperature with adhesive 6' in between. While the resistance substrate 1 and the cooling board 3 are pressed together, and the grooves 5 serve to hold any adhesive material displaced in the pressing process.

However, in cases of the conventional thermal print head as illustrated in FIGS. 3 and 4, local heat accumulation can occur in the resistance substrate 1 when an air bubble, having a high thermal conductivity, is formed in the adhesive 6', or when the cooling compound 6 and the adhesive 4 overlap one another when the resistance substrate 1 and the cooling board 3 are adhered. In addition, it is also disadvantageous that insufficient heat dissipation occurs in high speed printing through the use of only the cooling compound 6 or the adhesive 6'.

SUMMARY OF THE INVENTION

The present invention overcomes the problems and disadvantages of the prior art by providing a thermal print head and method of making the same in which a metal film and a cooling compound are inserted between a resistance substrate and a cooling board.

To achieve the objects and in accordance with the purpose of the invention, as embodied and broadly described herein, the thermal print head includes a resistance substrate having front and rear surfaces, the rear surface having first and second regions, the front surface having a third region opposite the first region, a plurality of heating elements mounted on the resistance substrate in the third region, a cooling board positioned near the rear surface of the resistance substrate, the cooling board having a principle plane with a first part corresponding to the first region of the rear surface of the resistance substrate and with a second part corresponding to the second region of the rear surface of the resistance substrate, a cooling compound with high thermal conductivity, positioned between the first region of the resistance substrate and the first part of the cooling board, a metal film with high thermal conductivity, positioned inside the cooling compound, and an adhesive positioned between the second region of the rear surface of the resistance substrate and the second part of the cooling board, the adhesive bonding the resistance substrate and the cooling board, wherein at least one groove is formed on the principal plane of the cooling board, the at least one groove being formed between the first region and the second region, thereby separating the cooling compound from the adhesive.

Furthermore, thickness of the metal film may be more than tens of microns and less than that of the adhesive, and the metal film may be made of copper or aluminum with high thermal conductivity. The cooling board may be made of a tacky agent, for example, silicon grease. Furthermore, the thermal print head may include a driving substrate connected to the driving integrated circuit and attached on the cooling board, and a driving integrated circuit attached to the driving substrate for separately driving the heating elements and the resistance substrate. The thermal print head may further include a protector for covering and protecting the driving integrated circuit, and a cover for covering over the protector.

According to another aspect of the present invention, a method for making a thermal print head includes the steps of adhering double-sided tape to a first part of a principal plane of a cooling board, depositing a first placement of cooling compound on a second part of the principle plane of the cooling board, the second part being separated from the first part by at least one groove formed on the principle plane of the cooling board; placing a metal film on the first placement of cooling compound, depositing a second placement of cooling compound on the metal film, and adhering the resistance substrate to the cooling board.

In this method a plurality of heating elements are formed on a front surface of the resistance substrate and a rear surface of the resistance substrate is adhered to the cooling board such that the heating elements are directly above the second part of the cooling board.

As described above, the formation of air bubbles in the cooling compound can be prevented by inserting the metal film, and the local heat accumulation can be reduced, thereby reducing uneven contrast since even if an air bubble is formed it will have a thickness less than the thickness of a double-sided tape that acts as an adhesive between the resistance substrate and the cooling board. In addition, a clearer image can be obtained even in the high speed printing because the metal film having a thermal conductivity higher than that of the cooling compound is inserted inside the cooling compound. This increases the overall thermal conductivity between the resistance substrate and the cooling board and thus improves heat dissipation within the system.

Additional objects and advantages of the invention will be set forth in part in the description which follows, and will be clear from the description. The objects and advantages of the invention will be realized and attained by means of the elements and combinations particularly pointed out in the appended claims.

BRIEF DESCRIPTION OF THE DRAWINGS

The accompanying drawings illustrate embodiments of the invention and, together with the description, serve to explain the principles of the invention.

DESCRIPTION OF A PREFERRED EMBODIMENT

Reference will now be made in detail to preferred embodiment of the present invention, examples of which are illustrated in the accompanying drawings. Wherever possible, the same reference numbers will be used throughout the drawings to refer to the same or like parts.

Figure 1:
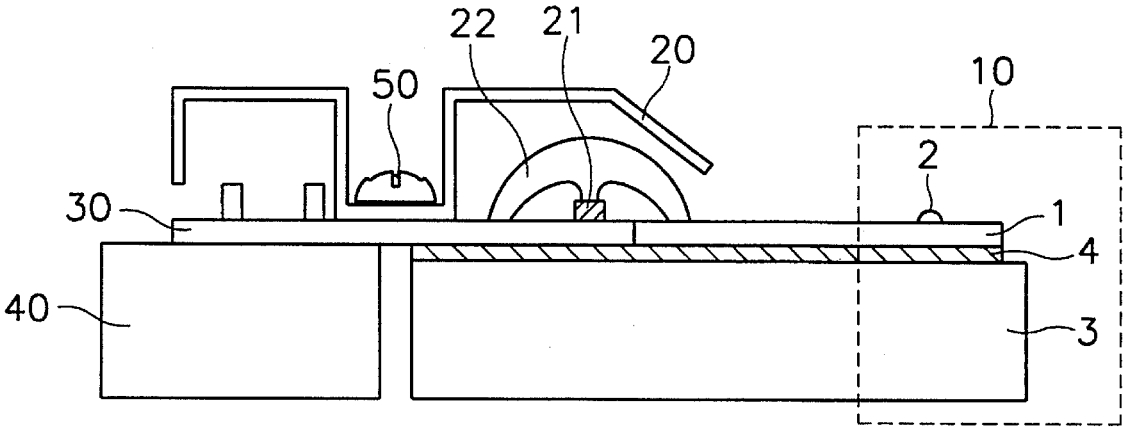
FIG. 1 (Prior Art)
FIG. 1 is a sectional view illustrating a conventional thermal print head.
Figure 2:
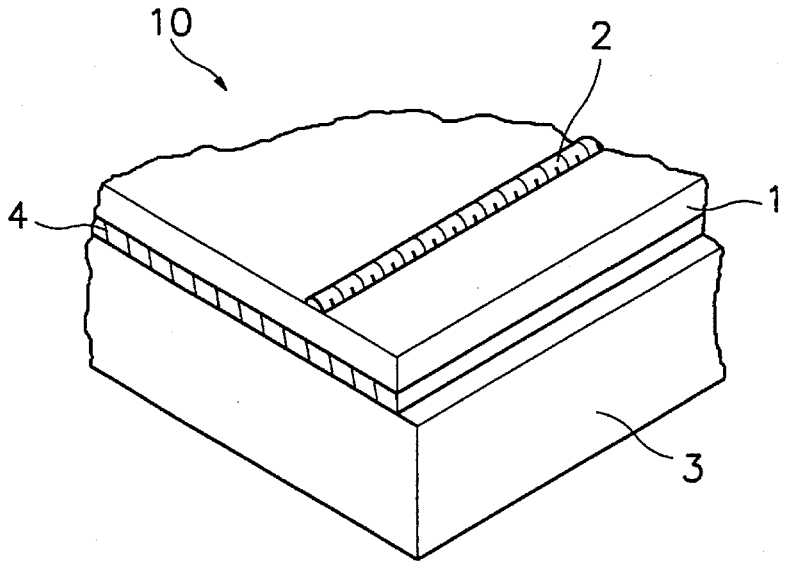
FIG. 2 (Prior Art)
FIG. 2 is a perspective view illustrating one design for the interface of the resistance substrate and the cooling board in the thermal print head of FIG. 1.
Figure 3:
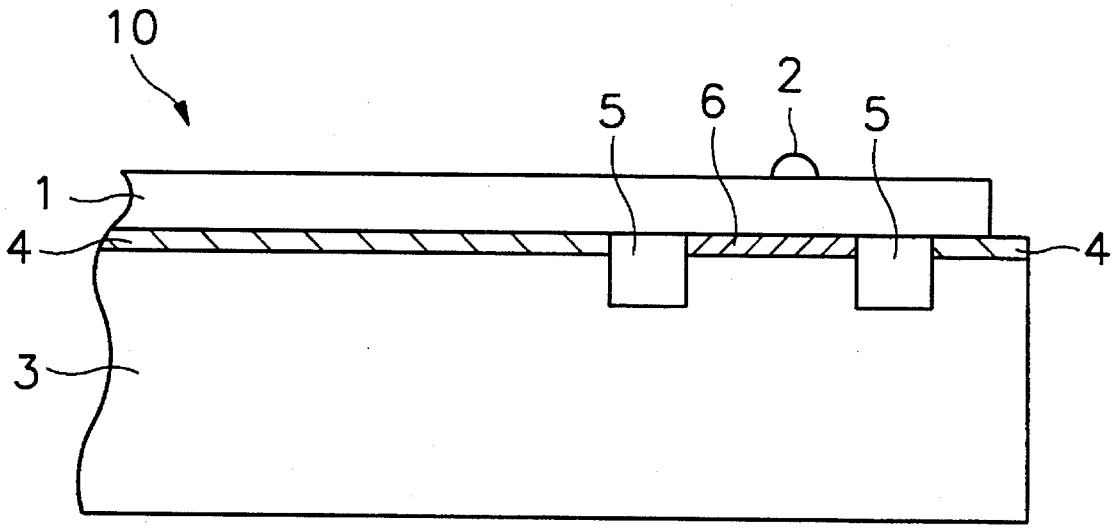
FIG. 3 (Prior Art)
FIG. 3 is a perspective view illustrating an alternate design for the interface of the resistance substrate and the cooling board in the thermal print head of FIG. 1.
Figure 4:
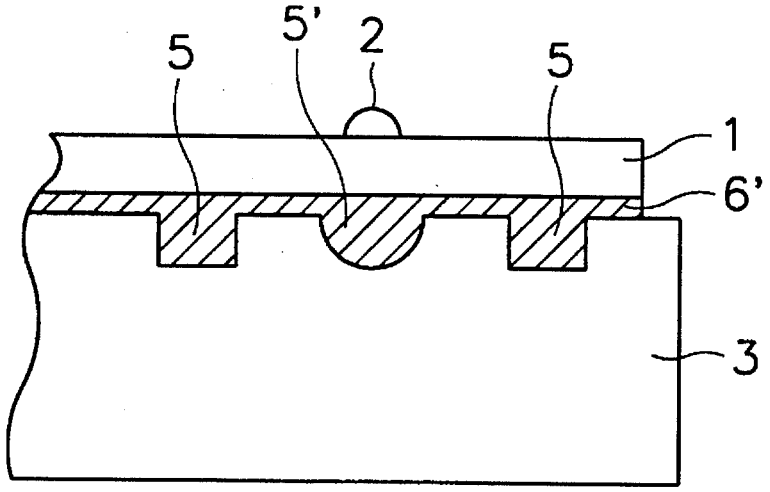
FIG. 4 (Prior Art)
FIG. 4 is a perspective view illustrating an alternate design for the interface of the resistance substrate and the cooling board in the thermal print head of FIG. 1.
Figure 5:
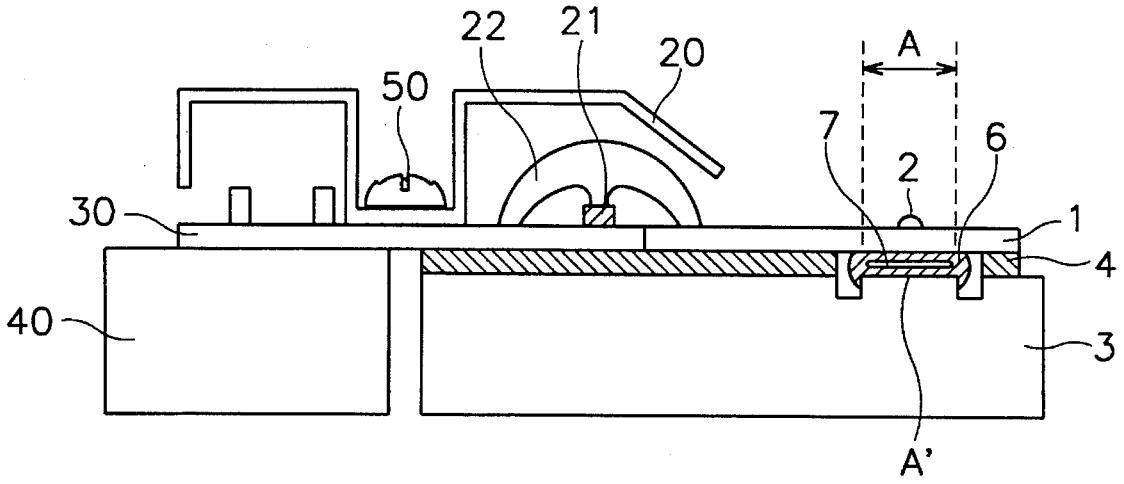
FIG. 5 is a sectional view illustrating a thermal print head according to a preferred embodiment of the present invention.
Figure 6:
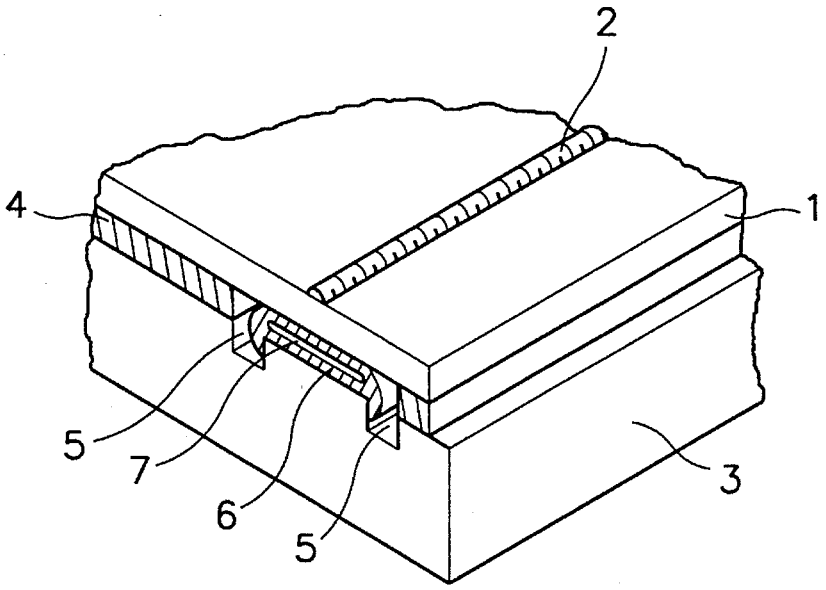
FIG. 6 is a perspective views illustrating a preferred embodiment for the interface of the resistance substrate and the cooling board in the thermal print head of FIG. 1.

FIG. 5 is a sectional view illustrating a thermal print head according to a preferred embodiment of the present invention. FIG. 6 is a perspective view illustrating a preferred embodiment for the interface of the resistance substrate and the cooling board in the thermal print head of FIG. 1.

A plurality of heating elements 2 for convening electrical energy into heat energy are formed on a front surface of a resistance substrate 1. The resistance substrate 1 is a panel having electrical insulating characteristic and rigidity, and is preferably made out of an alumina ceramic. The heating elements are formed linearly like a row of dots. A rear surface of the resistance substrate 1 is divided into two regions, a first region X corresponding to the area on the front surface where the heating elements 2 are formed, and a second region corresponding to the remainder of the resistance substrate 1.

The cooling board 3 is preferably made of a light alloy material such as an aluminum alloy and is formed in a lower part of the resistance substrate 1. A principal plane of the cooling board 3 facing the resistance substrate 1 includes a first part X' corresponding to the first region X of the rear surface of the resistance substrate 1 and a second part corresponding to the second region of the rear surface of the resistance substrate 1.

An adhesive 4 is inserted between the second region of the rear surface of the resistance substrate 1 and the second part of the cooling board 3. This adhesive 4 bonds the resistance substrate 1 to the cooling board. Preferably, a double-sided tape is used as the adhesive 4, although any other acceptable adhesive may be used.

A cooling compound 6 with a high thermal conductivity is inserted between the rear surface of the resistance substrate 1 at the first region X and the top surface of the cooling board 3 at the first part X'. A metal film 7 with a high thermal conductivity is inserted inside the cooling compound 6. A silicon grease is preferably used as the cooling compound 6, although, some other tacky agent in which fine particles such as aluminum oxide or zinc oxide and silicon oil are mixed may be used. In addition, copper or aluminum, having a high thermal conductivity, is preferably used as the material for the metal film 7, although any other suitable high-conductivity metal may be used. It is preferable that thickness of the metal film 7 be greater than tens of microns and less than the thickness of the adhesive 4.

Two grooves 5 are formed between the principal plane of the first region X and the second region, and serve to separate the cooling compound 6 from the adhesive 4. Although two long grooves are disclosed in the preferred embodiment, a single groove or more than two grooves can also be used within the scope of this invention.

In addition, the preferred embodiment of the thermal print includes a driving substrate 30 having a driving integrated circuit 21 formed on it. The cooling board 3 is adhered to the driving substrate 30 by the adhesive 4 and thus supports the driving substrate 30. The driving integrated circuit 21 separately drives the resistance substrate 1 and the heating elements 2. A protector 22 protects the driving integrated circuit 21 by coating the driving integrated circuit 21 and a cover 20 provides further protection by covering over the protector 22. The cover 20 is preferably attached to the driving substrate 30 by a screw 50, although any suitable fastening means may be used.

A method for making the thermal print head according to the preferred embodiment of the present invention will now be explained below.

First, the adhesive 4 is attached to the second part of the cooling board 3, outside of where the two grooves 5 are formed. A cooling compound 6 is then deposited on the first part X' of the cooling board 3, between the two grooves 5, using silk printing. The metal film 7 is then placed on the deposited cooling compound 6, and additional cooling compound 6 is then deposited on the metal film 7 using silk printing. Lastly, the resistance substrate 1 is aligned and attached to the cooling board 3. After the resistance substrate 1 is attached, the driving integrated circuit is attached using a method identical with the method for making a conventional print head. Such method is well known in the art and so need not be described here.

As described above, inserting the metal film 7 inside the cooling compound 6 can prevent the formation of an air bubble in the cooling compound 6. This reduces the local heat accumulation and thereby reduces uneven contrast. In addition, even if an air bubble is formed, its thickness will be less than that of the adhesive 4 because the metal film 7 bisects the area where the cooling compound 6 is spread. In addition, a clearer image can be obtained even in the high speed printing because the metal film 7, having a thermal conductivity higher than that of the cooling compound 6, is inserted inside the cooling compound 6. This increases the overall thermal conductivity between the resistance substrate 1 and the cooling board 3 and thus improves heat dissipation within the system.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A thermal print head, comprising:

a resistance substrate having front and rear surfaces, the rear surface having first and second regions, the front surface having a third region opposite the first region;

a plurality of heating elements mounted on the resistance substrate in the third region;

a cooling board positioned near the rear surface of the resistance substrate, the cooling board having a principle plane with a first part corresponding to the first region of the rear surface of the resistance substrate and with a second part corresponding to the second region of the rear surface of the resistance substrate;

a cooling compound with high thermal conductivity, positioned between the first region of the resistance substrate and the first part of the cooling board;

a metal film with high thermal conductivity, positioned inside the cooling compound; and an adhesive positioned between the second region of the rear surface of the resistance substrate and the second part of the cooling board, the adhesive bonding the resistance substrate and the cooling board, wherein at least one groove is formed on the principal plane of the cooling board, the at least one groove being formed between the first region and the second region, thereby separating the cooling compound from the adhesive.

2. The thermal print head of claim 1, wherein thickness of the metal film is more than ten microns and less than a thickness of the adhesive

3. The thermal print head of claim 1, wherein the metal film is made of copper or aluminum.

4. The thermal print head of claim 1, wherein the cooling compound comprises a tacky agent having a high viscosity.

5. The thermal print head of claim 1, wherein the cooling compound comprises silicon grease.

6. The thermal print head of claim 1, further comprising:

a driving substrate connected to the driving integrated circuit and attached on the cooling board; and a driving integrated circuit attached to the driving substrate for separately driving the heating elements and the resistance substrate.

7. The thermal print head of claim 6, further comprising a protector for covering and protecting the driving integrated circuit.

8. The thermal print head of claim 7, further comprising a cover for covering over the protector.

* * * * *